US008731453B2

(12) United States Patent
Inoue

(10) Patent No.: US 8,731,453 B2
(45) Date of Patent: May 20, 2014

(54) IMAGE FORMING APPARATUS THAT CONTROLS SPEED OF MEDIA CONVEYED TO A TRANSFER UNIT

(75) Inventor: Hiroyuki Inoue, Tokyo (JP)

(73) Assignee: Oki Data Corporation, Tokyo (JP)

( * ) Notice: Subject to any disclaimer, the term of this patent is extended or adjusted under 35 U.S.C. 154(b) by 568 days.

(21) Appl. No.: 12/791,078

(22) Filed: Jun. 1, 2010

(65) Prior Publication Data

US 2010/0303530 A1 Dec. 2, 2010

(30) Foreign Application Priority Data

Jun. 1, 2009 (JP) ..... 2009-132248

(51) Int. Cl.
*G03G 15/00* (2006.01)
*B65H 5/34* (2006.01)

(52) U.S. Cl.
USPC ..... 399/396; 271/270

(58) Field of Classification Search
CPC ..... G03G 2215/00599
USPC ..... 399/396; 271/270
See application file for complete search history.

(56) References Cited

U.S. PATENT DOCUMENTS 5,018,716 A * 5/1991 Yoshida et al. ..... 271/227
6,014,542 A * 1/2000 Hozumi et al. ..... 399/394
6,920,308 B2 * 7/2005 Demchock et al. ..... 399/396
7,289,754 B2 * 10/2007 Miyasaka et al. ..... 399/267
8,320,804 B2 * 11/2012 Udaka et al. ..... 399/302

FOREIGN PATENT DOCUMENTS

JP 2008-076728 A 4/2008
JP 2008-268602 A 11/2008
JP 2008-276014 A 11/2008

* cited by examiner

*Primary Examiner* — Ren Yan
*Assistant Examiner* — Justin Olamit
(74) *Attorney, Agent, or Firm* — Marvin A. Motsenbocker; MOTS Law, PLLC

(57) ABSTRACT

An image forming apparatus includes: an intermediate transfer member onto which a image is primarily transferred from an image forming unit; a transfer unit to secondarily transfer the image from the intermediate transfer member to a media at a secondary-transfer position; a conveying unit configured to convey the media to the secondary-transfer position; and a conveying speed controller to control a speed of conveying the media. The conveying unit includes a first detector and a second detector downstream the first detector and upstream the secondary-transfer position. Based on a detection of the media by the first detector and a timing at which the image forming unit forms the image, the conveying speed controller changes the conveying speed until the second detector detects the media and changes, after the second detector detects the media, the conveying speed to a speed substantially the same as the intermediate transfer member speed.

20 Claims, 9 Drawing Sheets

ENLARGED CHART OF PART OF FIG. 11

IMAGE FORMING APPARATUS THAT CONTROLS SPEED OF MEDIA CONVEYED TO A TRANSFER UNIT

CROSS REFERENCE TO RELATED APPLICATIONS

This application claims priority based on 35 USC 119 from prior Japanese Patent Application No. P2009-132248 filed on Jun. 1, 2009, entitled "Image Forming Apparatus", the entire contents of which are incorporated herein by reference.

BACKGROUND OF THE INVENTION

1. Field of the Invention

The invention relates to an image forming apparatus of the intermediate transfer type. Specifically, the invention relates to a configuration to convey a medium.

2. Description of the Related Art

A conventional image forming apparatus of the intermediate transfer type, such as a printer, photocopier, fax machine, or multifunction machine, is configured to first transfer a toner image onto an intermediate transfer belt (this transfer is called the "primary transfer"), and to then transfer the toner image from the intermediate transfer belt onto a sheet of paper (this transfer is called the "secondary transfer"). (See Japanese Patent Application Publication 2008-76728, for example.)

SUMMARY OF THE INVENTION

In the image forming apparatus of the intermediate transfer type, like image forming apparatuses of other types, it is preferable to improve the throughput of the printing while maintaining the image quality.

A first aspect of the invention is an image forming apparatus including: an image forming unit configured to form an image on the basis of image data; an intermediate transfer member configured to be driven at a predetermined speed, the developer image being primarily transferred from the image forming unit onto the intermediate transfer member; a transfer unit configured to secondarily transfer the image from the intermediate transfer member onto a media at a secondary-transfer position; a conveying unit configured to convey the media to the secondary-transfer position to secondarily transfer the image formed on the intermediate transfer member onto the media; and a conveying speed controller configured to control the speed at which the conveying unit conveys the media. The conveying unit includes: a first detector configured to detect the media; and a second detector provided downstream of the first detector in the media conveying direction and upstream of the secondary-transfer position in the media conveying direction. Based on the detection of the media by the first detector and the time at which the image forming unit forms the image, the conveying speed controller changes the conveying speed of the media until the second detector detects the media, and after the second detector detects the media, the conveying speed controller changes the conveying speed to a speed substantially the same as the speed of the intermediate transfer member.

Note that the definition that the conveying speed of the media and the speed of the intermediate transfer member are substantially the same in this application means that the ratio of the difference between the speed of the intermediate transfer member and the conveying speed of the media to the speed of the intermediate transfer member is in the range of ±15%, and preferably is in the range of ±5%.

According to the first aspect of the invention, the conveyed media is not stopped in the middle of its conveyance path, so that the apparatus of the first aspect has a higher throughput in the printing of successive sheets than in the conventional case where the media is stopped and controlled.

In addition, secondary-transfer is synchronized with the media on the basis of the positions of the conveyed images provided at certain intervals used as a reference. Thus, the image-start position measured from the leading edge of the media is stabilized, and also the throughput is stabilized.

BRIEF DESCRIPTION OF THE DRAWINGS

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

DETAILED DESCRIPTION OF EMBODIMENTS

Preferred embodiments of the invention can be clearly understood from the description below while referring to the accompanying drawings. The drawings are only for the purpose of description, and not for the purpose of limiting the scope of the invention.

First Embodiment (Configuration of First Embodiment)

Figure 1:
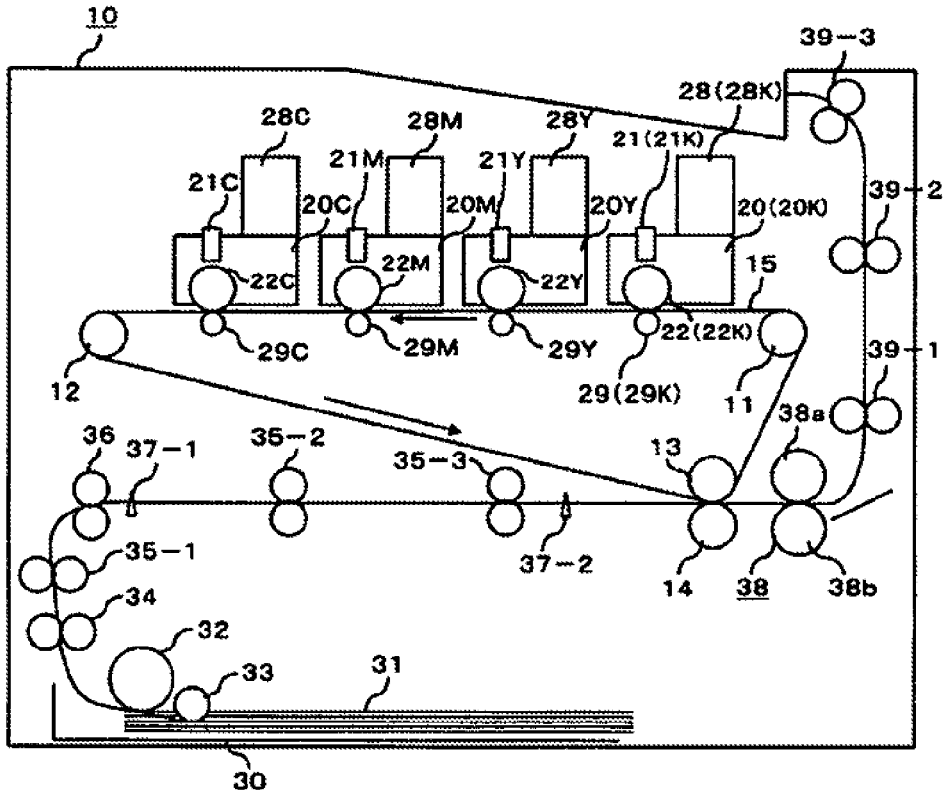
FIG. 1 is a sectional diagram illustrating a principal portion of image forming apparatus 10 according to a first embodiment of the invention.

FIG. 1 is a cross-sectional diagram illustrating the principal portion of an image forming apparatus according to the first embodiment of the invention.

An example of image forming apparatus 10 is a color electro-photographic printer. Image forming apparatus 10 includes an intermediate transfer member such as an endless belt (e.g., intermediate transfer belt 15). Intermediate transfer belt 15 is rotationally driven by rotary members (e.g., driven roller 11 and driving roller 12). A developer image (e.g., a toner image) is primarily transferred onto intermediate transfer belt 15. Driving roller 12 rotationally drives intermediate transfer belt 15 whereas driven roller 11 is rotationally driven by intermediate transfer belt 15. Intermediate transfer belt 15 is looped around driven roller 11, driving roller 12, and a secondary-transfer unit (e.g., a pair of rollers 13 and 14) located at the secondary-transfer position. Rollers 13 and 14 hold the conveyed recording media (e.g., a sheet of paper) 31 in contact with intermediate transfer belt 15 onto which the toner image was primarily transferred. A voltage of the opposite polarity of the charged toner is applied to roller 14, thereby secondarily transferring the toner image onto sheet of paper 31.

Plural image forming units 20 (e.g., image forming unit 20K configured to form a black image, image forming unit 20Y configured to form a yellow image, image forming unit 20M configured to form a magenta image, and image forming unit 20C configured to form a cyan image) are provided between driven roller 11 and driving roller 12, along intermediate transfer belt 15. Each image forming unit 20 includes exposure unit 21 (e.g., light-emitting diode head, hereafter referred to as an "LED head", specifically, LED heads 21K, 21Y, 21M, 21C) and image carrier 22 (specifically, photoreceptors 22K, 22Y, 22M, and 22C). Each LED head 21 forms a latent image on the surface of the corresponding image carrier 22. Toner cartridge 28 (specifically, toner cartridges 28K, 28Y, 28M, and 28C) is detachably attached to each of image forming units 20, and stores toner (developer) used to develop the latent image formed on the surface of corresponding image carrier 22.

Primary-transfer rollers 29 (specifically, primary-transfer rollers 29K, 29Y, 29M, and 28C) contact their respective photoreceptors 22 (specifically, photoreceptors 22K, 22Y, 22M, and 22C) with intermediate transfer belt 15 located in between. The latent image formed on corresponding photoreceptor 22 by corresponding LED head 21 is developed with the toner supplied by corresponding toner cartridge 28, and the developed image is transferred (primarily transferred) onto intermediate transfer belt 15 by corresponding primary transfer roller 29.

Sheet tray 30 for storing sheets of paper 31 is detachably attached to the lower portion of image forming apparatus 10. Paper-feed roller 32, subsidiary paper-feed roller 33, and register rollers 34 are provided above the leading edge in the sheet-feeding direction in sheet tray 30. When a printing operation is started, paper-feed roller 32 and subsidiary paper-feed roller 33 feed paper sheet 31 from sheet tray 30 towards register rollers 34. Paper sheet 31 is brought into contact with register rollers 34, which corrects any skew of paper sheet 31.

A pair of conveying rollers 35-1 (serving as a first conveying device), register rollers 36, first detector 37-1 (e.g., first conveyance sensor), pairs of conveying rollers 35-2 and 35-3 (serving as a second conveying device), second detector 37-2 (e.g., second conveyance sensor), and rollers 13 and 14 for secondary transfer are provided downstream of register rollers 34 along the conveying path of paper sheet 31. Register rollers 36 are configured to supply sheet of paper 31 to the secondary-transfer position. The two pairs of conveying rollers 35-2 and 35-3 are driven simultaneously. First conveyance sensor 37-1 is configured to detect the arrival of paper sheet 31 at a first position. Second conveyance sensor 37-2 is configured to generate a trigger signal that causes the speed at which paper sheet 31 is conveyed to change to the final speed. The trigger signal is also used as a trigger signal to control the secondary-transfer voltage applied to roller 14 for secondary transfer.

Fuser 38, plural pairs of conveying rollers 39-1, 39-2, 39-3 for conveying paper sheet 31 are provided downstream of rollers 13 and 14 for secondary transfer along the path for conveying paper sheets 31. Fuser 38 includes fusing roller 38*a* and back-up roller 38*b*. Fusing roller 38*a* fuses toner secondarily transferred onto paper sheet 31. Back-up roller 38*b* is opposed to fusing roller 38*a*. Fuser 38 uses these rollers 38*a* and 38*b* to hold paper sheet 31 onto which the toner image has been transferred. While paper sheet 31 is held between rollers 38*a* and 38*b*, heat and pressure are applied to fuse the toner image to paper sheet 31. Pairs of conveying rollers 39-1 to 39-3 convey paper sheet 31 with the fused toner image to a stacker.

Figure 2:
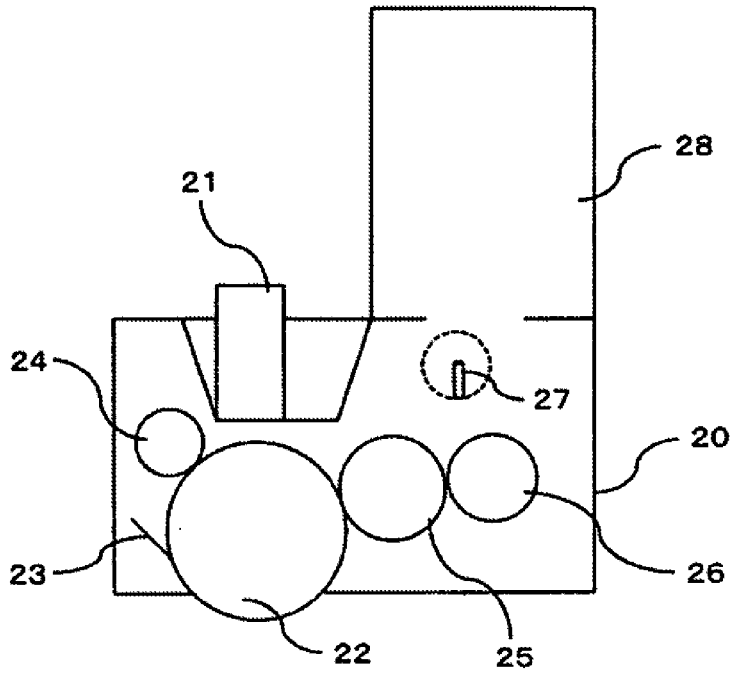
FIG. 2 is an enlarged diagram illustrating, in detail, the configuration of image forming unit 20 shown in FIG. 1, and specifically illustrating image forming unit 20 and toner cartridges 28.

FIG. 2 is an enlarged diagram illustrating, in detail, the configuration of image forming unit 20 shown in FIG. 1, and specifically illustrating image forming unit 20 and toner cartridge 28.

Each image forming unit 20 includes photoreceptor 22, which is exposed to light emitted by LED head 21. Cleaning member 23, charging roller 24, and developing roller 25 are in contact with photoreceptor 22. Cleaning member 23 removes any toner remaining on photoreceptor 22 after the process of primary transfer. Charging roller 24 uniformly charges the surface of photoreceptor 22. Developing roller 25 is develops the latent image on photoreceptor 22 with toner supplied by supplying roller 26. Toner sensor 27 is provided near supplying roller 26, and detects, within image forming unit 20, the amount of toner supplied from toner cartridge 28.

Figure 3:
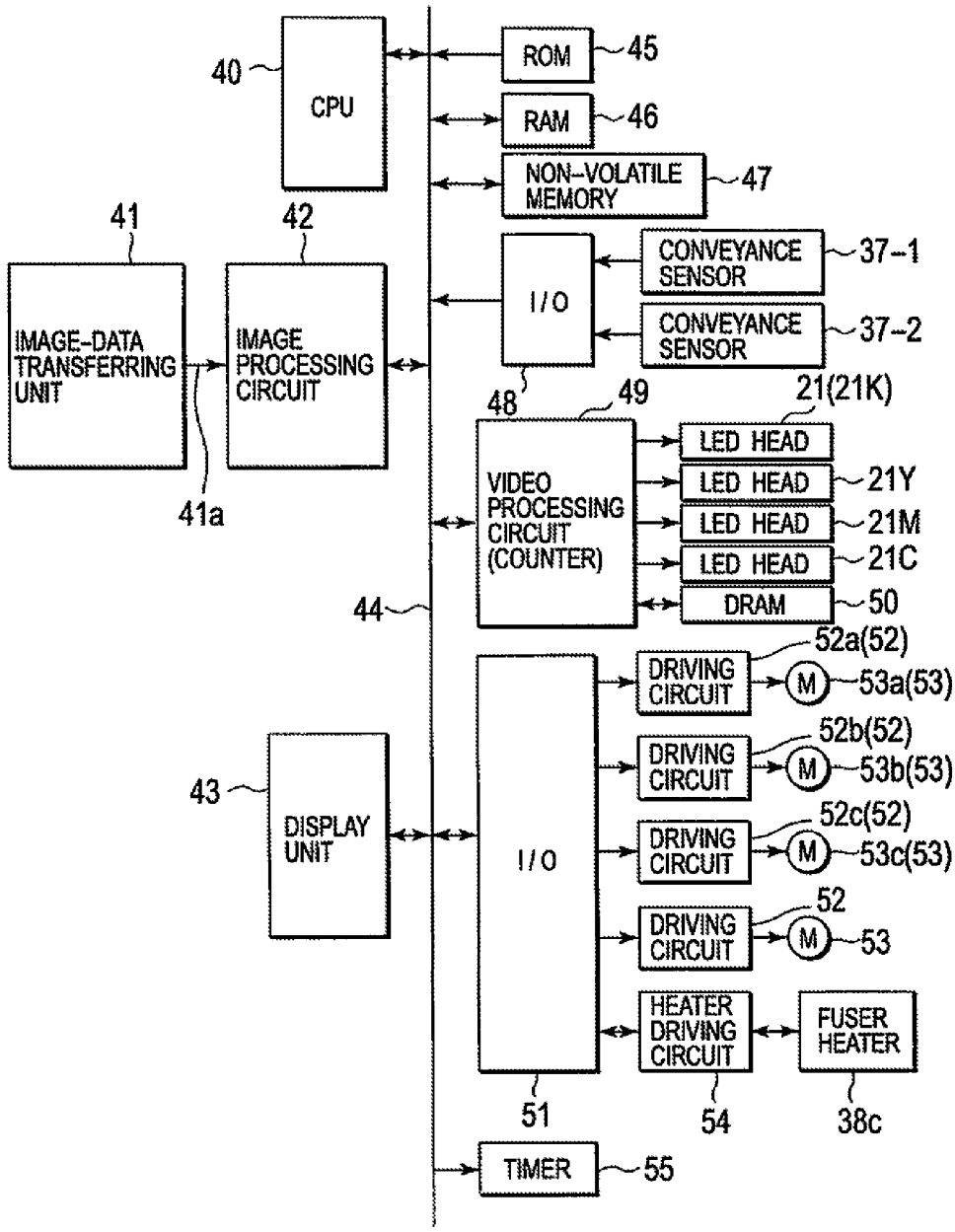
FIG. 3 is a block diagram illustrating the circuit configuration of image forming apparatus 10 shown in FIG. 1.
Figure 10:
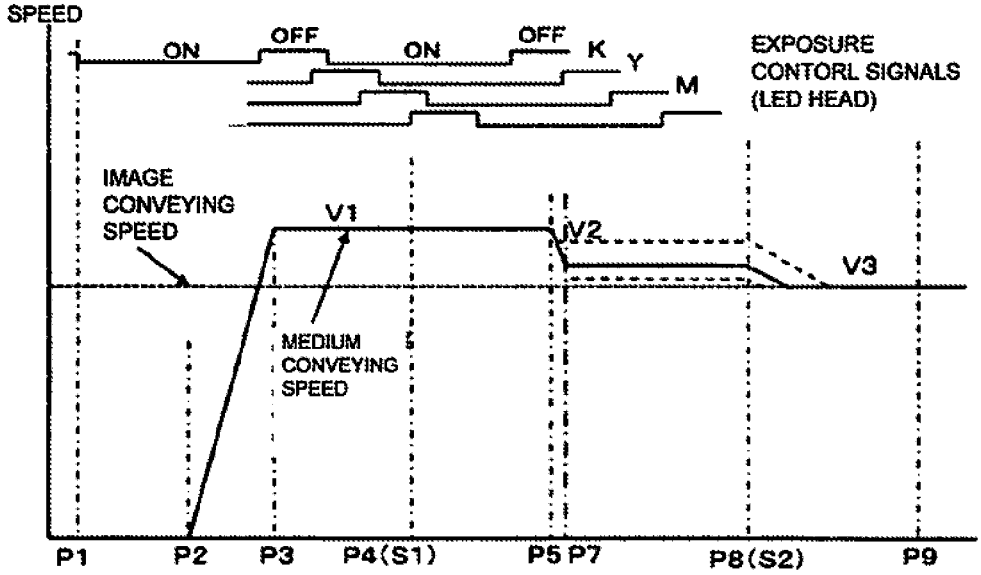
FIG. 10 is a chart illustrating a method of adjusting the speed according to the second embodiment when the conveyance of sheet of paper 31 is delayed relative to the conveyance of the image (the conveyance of the image progresses ahead of the conveyance of sheet of paper 31) in the operation shown in FIG. 4.

FIG. 3 is a block diagram illustrating the circuit configuration of image forming apparatus 10 shown in FIG. 10.

Image forming apparatus 10 shown in FIG. 1 includes controller 40 (e.g., central processing unit, hereafter referred to as "CPU"), which controls the overall operation of image forming apparatus 10. Image forming apparatus 10 also includes image processing circuit 42 and display unit 43, both of which are controlled by CPU 40. CPU 40, image processing circuit 42, and display unit 43 are connected to bus 44. Image processing circuit 42 receives image data sent via connecting unit 41*a* from image-data transferring unit 41, such as a personal computer (hereafter, referred to as "PC") or an external apparatus, connected to image forming apparatus 10. Image processing circuit 42 then converts the received image data to a printable data format. Display unit 43 is used to monitor the state of image forming apparatus 10. Display unit 43 is also to instruct the operator to take actions.

Read-only memory 45 (hereafter, referred to as "ROM"), random-access memory 46 (hereafter, referred to as "RAM"), non-volatile memory 47, input-output port 48 (hereafter, referred to as "I/O port"), video processing circuit 49 including a counter circuit, another I/O port 51, and timer 55 are connected to bus 44.

ROM 45 stores control programs to operate image forming apparatus 10. RAM 46 provides a work space necessary for controlling image forming apparatus 10. Non-volatile memory 47 stores information which is necessary for controlling image forming apparatus 10 and is required to be non-volatile (to be kept even after the power supply is cut off. I/O port 48 is used to acquire the detection results of such sensors as conveyance sensors 37-1 and 37-2. Video processing circuit 49, including a counter circuit, outputs the image data converted by image processing circuit 42 to each LED head 21 (specifically, LED heads 21K, 21Y, 21M, and 21C). Video processing circuit 49 also counts how many on-dots have been output. Memory 50 (e.g., dynamic RAM, hereafter, referred to as "DRAM") is connected to video processing circuit 49.

DRAM 50 temporarily stores the image data before video processing circuit 49 outputs the image data. I/O port 51 outputs control signals to, for example, plural driving circuits 52, which drive various kinds of driving motors 53. Note that driving motors 53 include: driving motor 53*a* (a first driving source) which is the driving source for the first conveying device comprising the pair of conveying rollers 35-1); and driving motor 53*b* (a second driving source) which is the driving source for the second conveying device comprising the pairs of conveying rollers 35-2 and 35-3. I/O port 51 also controls heater driving circuit 54, which drives heater 38*c* of fuser 38. Timer 55 executes time processing necessary for the control.

(Operation of First Embodiment)

Figure 4:
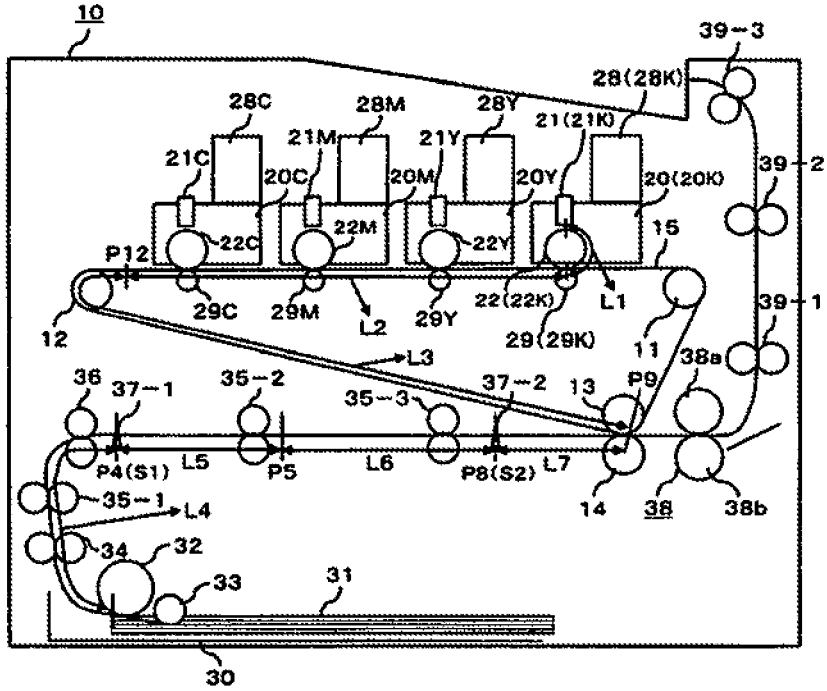
FIG. 4 is a diagram for describing the operation and corresponds to FIG. 1.
Figure 5:
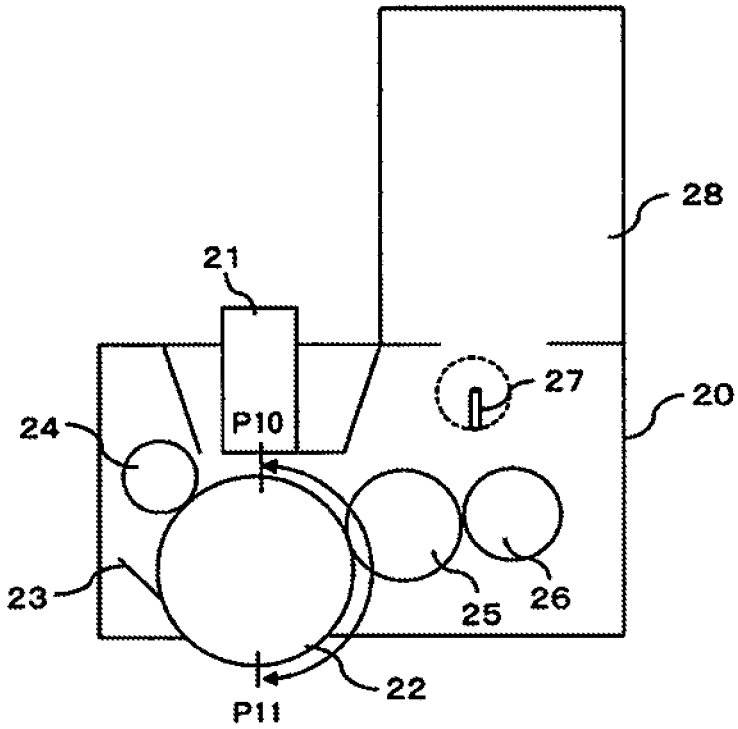
FIG. 5 is a diagram for describing the operation and corresponds to FIG. 2.
Figure 6:
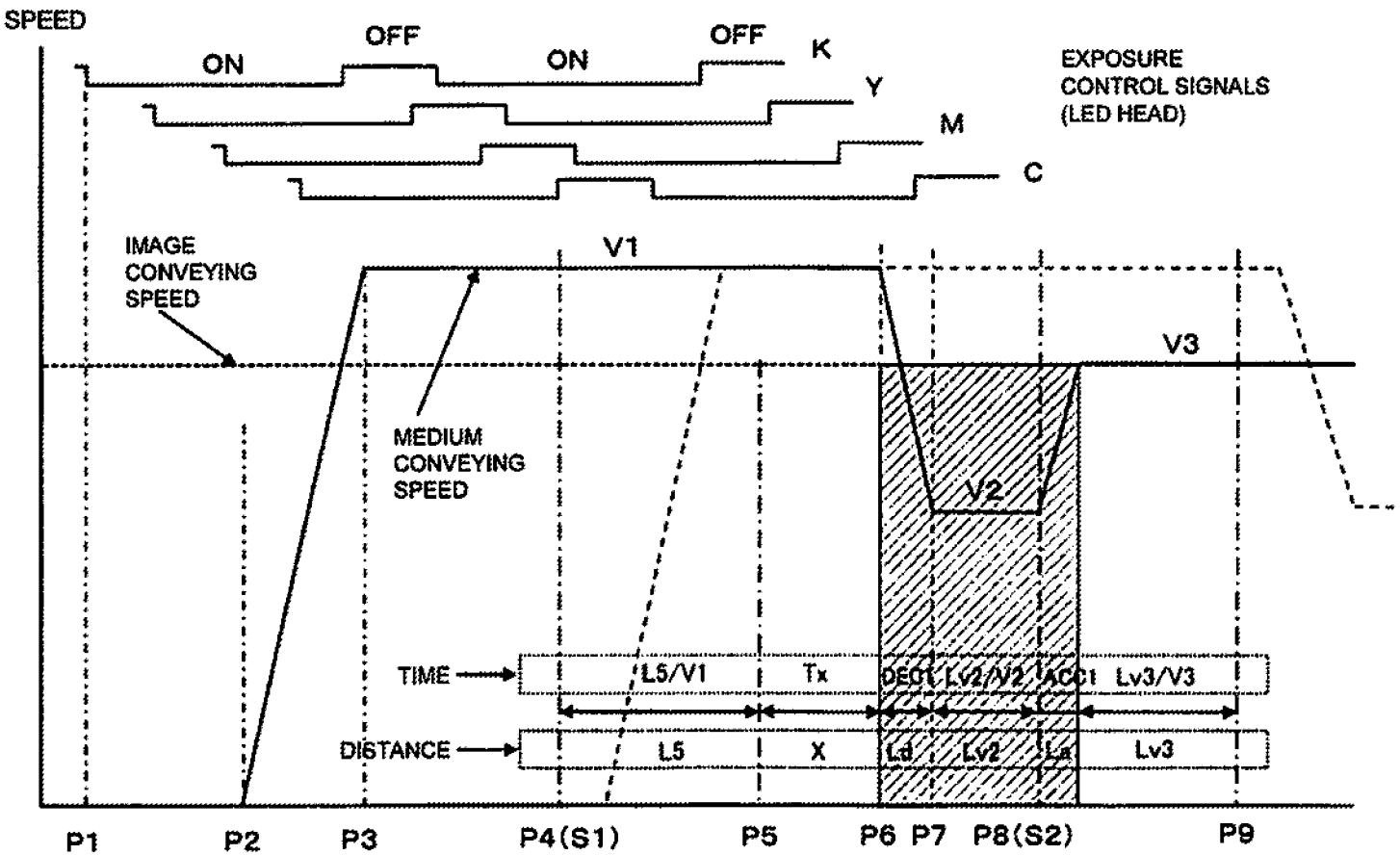
FIG. 6 is a chart illustrating a method of adjusting the timing according to the first embodiment of the invention when the conveyance of sheet of paper 31 progresses ahead of the conveyance of the image in the operation shown in FIG. 4.
Figure 7:
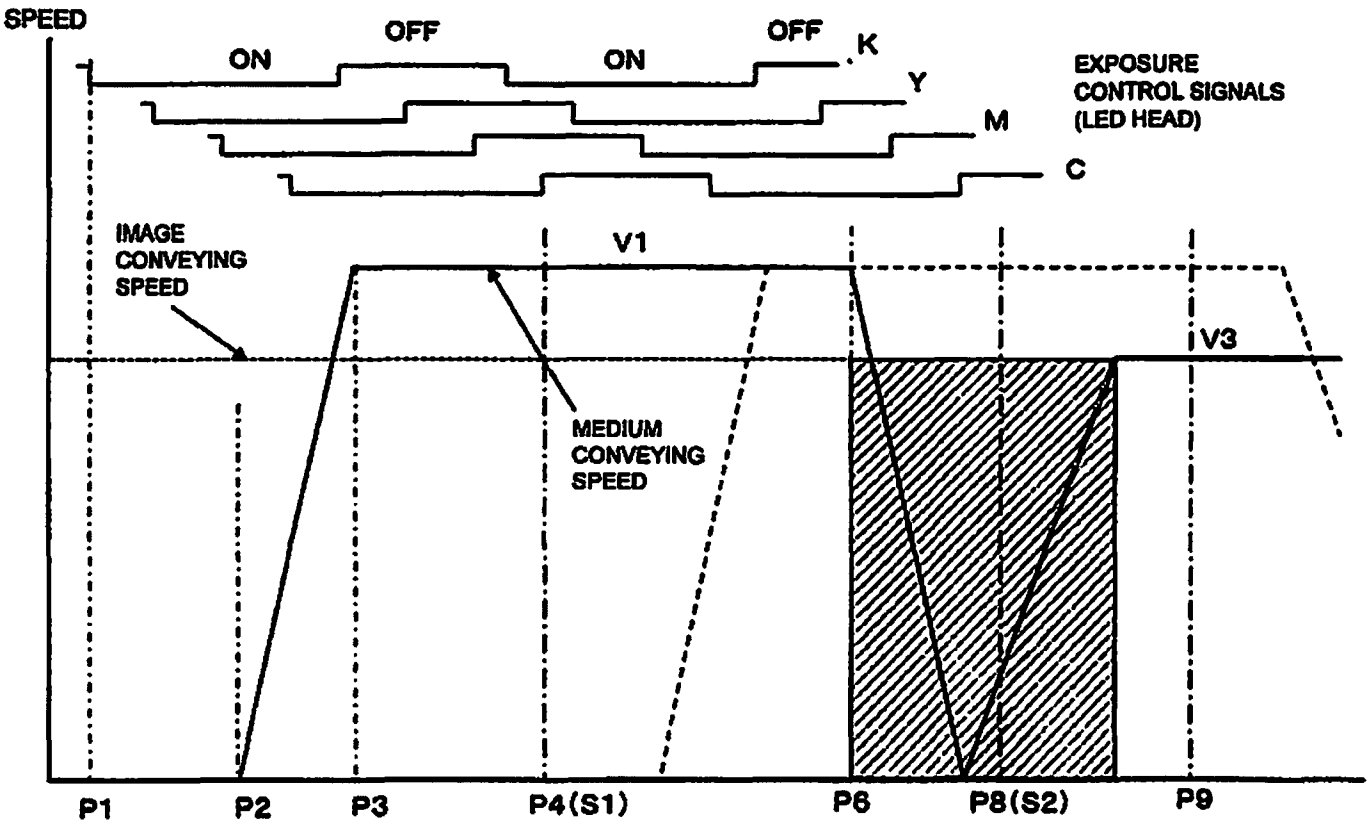
FIG. 7 is a chart to be compared with FIG. 6, and illustrates a comparison method of adjusting the timing when the conveyance of sheet of paper 31 progresses ahead of the conveyance of the image.
Figure 8:
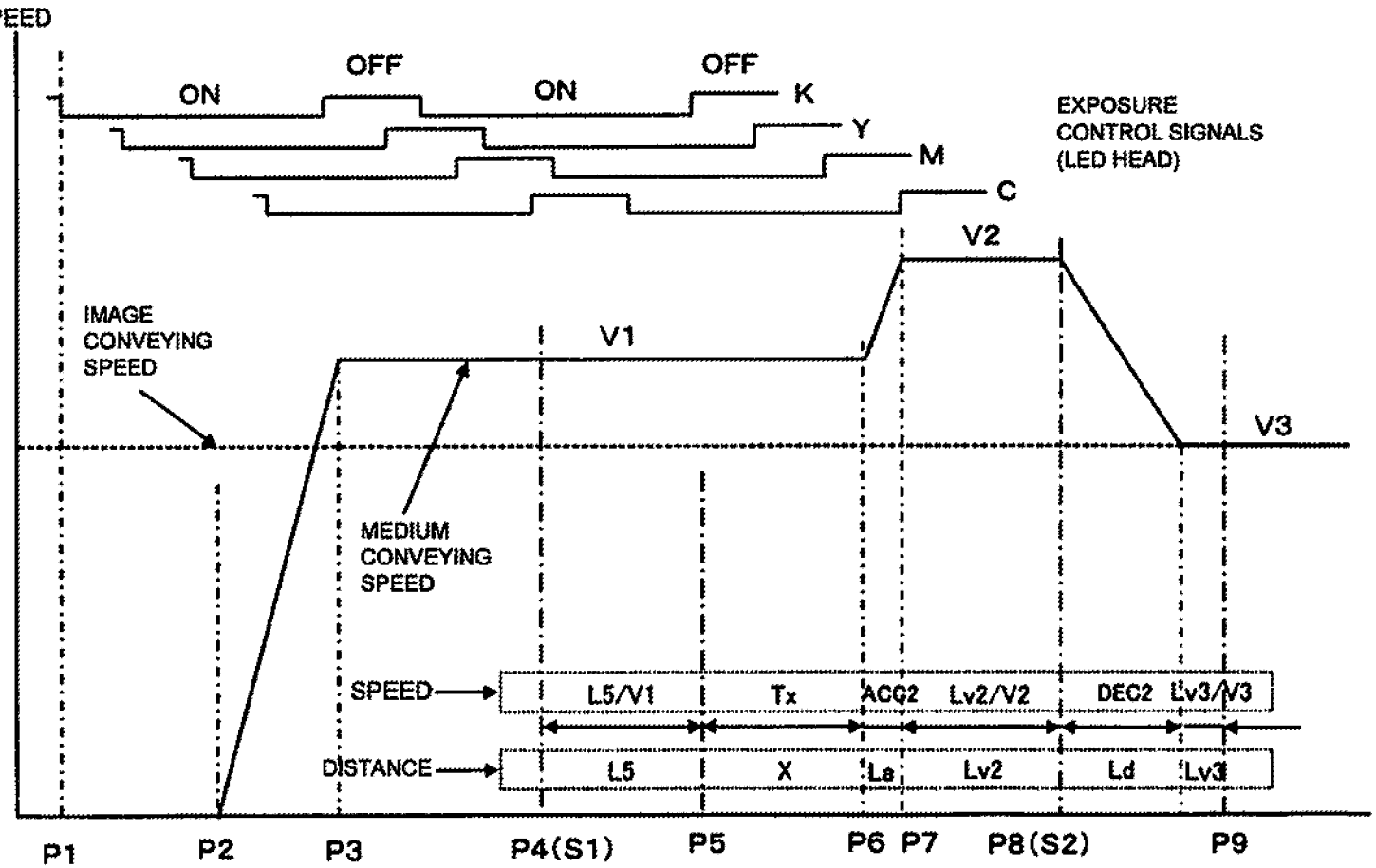
FIG. 8 is a chart illustrating a method of adjusting the timing according to the first embodiment of the invention when the conveyance of sheet of paper 31 is delayed relative to the conveyance of the image (the conveyance of the image progresses ahead of the conveyance of sheet of paper) in the operation shown in FIG. 4.

FIG. 4 is a diagram for describing the operation and corresponds to FIG. 1. FIG. 5 is a diagram for describing the operation and corresponds to FIG. 2. FIG. 6 is a chart illustrating the method of adjusting the timing according to the first Embodiment when the conveyance of paper sheet 31 progresses ahead of the conveyance of the image in the operation shown in FIG. 4. FIG. 7 is a chart to be compared with FIG. 6, and illustrates a comparison method of adjusting the timing when the conveyance of paper sheet 31 progresses ahead of the conveyance of the image. FIG. 8 is a chart illustrating the method of adjusting the timing according to the first embodiment when the conveyance of the image progresses ahead of the conveyance of paper sheet 31 (the conveyance of sheet of paper 31 is delayed relative to the conveyance of the image) in the operation shown in FIG. 4.

The operation of the first embodiment is described by referring to FIGS. 4 to 8. Note that in the following explanation and the figures, "image conveying speed" means the conveying speed of the toner image transferred on intermediate transfer belt 15, that is, the moving speed of intermediate transfer belt 15.

Image forming apparatus 10 shown in FIG. 4 receives print image data from image-data transferring unit 41, such as a PC, shown in FIG. 3. Upon receiving the data image processing circuit 42 processes the data. When the data processing is finished and the data is converted to a printable data format, image forming apparatus 10 starts the printing operation. In image forming apparatus 10 of the intermediate transfer type, such as the one employed in the first embodiment, the distance from most upstream image forming unit 20K to the secondary-transfer position, where rollers 13 and 14 for secondary transfer are located, is commonly longer than the distance by which paper sheet 31 is conveyed from sheet tray 30 to the secondary-transfer position. So, the image forming process is started by image forming units 20 earlier than the start of the feeding of paper sheet 31.

The relationship between position P1 and position P2 shown in FIGS. 6 to 8 illustrates the relationship between the above-mentioned two distances.

Once the printing operation is started, LED head 21 first forms an electrostatic latent image at position P1. Then, after a predetermined time, paper-feed roller 32 and subsidiary paper-feed roller 33 start feeding paper sheet 31 at position P2. The speed of fed paper sheet 31 is accelerated up to a predetermined speed. At position P3, control of the sheet speed at a predetermined constant speed is started. Paper sheet 31 is fed at the constant speed until the leading edge of paper sheet 31 reaches position P4 (S1) where conveyance sensor 37-1 is located. Meanwhile, CPU 40 shown in FIG. 3 calculates the value of the timing (i.e., distance X) specifically described below.

In this calculation, CPU 40 calculates the timing at which the sheet-conveying speed is changed to the predetermined speed V2 that is slower than speed V1 at which paper sheet 31 is conveyed between position P3 and position P4. Specifically, CPU 40 calculates distance X (i.e., time Tx) which is the distance between position P5 and a position where the sheet-conveying speed starts to decelerate down to speed V2. Here, position P5 is the position reached by the leading edge of paper sheet 31 after passing the pair of conveying rollers 35-2 and moving further ahead by a predetermined distance.

Distance X thus calculated is used to identify position P6, which is distance X away from position P5. Sheet-conveying-roller driving motors 53 shown in FIG. 3 start to decelerate at position P6, and the speed reaches predetermined speed V2 at position P7. Once the speed reaches speed V2, it is held until second conveyance sensor 37-2 detects the leading edge of paper sheet 31. When conveyance sensor 37-2 detects the leading edge of paper sheet 31 at position P8 (S2), the sheet-conveying speed starts to be accelerated so that it matches the speed at which the toner image on intermediate transfer belt 15 is conveyed, before the leading end of sheet of paper 31 reaches secondary-transfer position P9. The conveying speed of paper sheet 31 is changed to speed V3 before the leading end of paper sheet 31 reaches secondary-transfer position P9. Speed V3 is the speed at which the transfer process can be performed appropriately. Paper sheet 31, whose speed has been increased to speed V3 somewhere upstream of secondary-transfer position P9 holds that speed until it reaches secondary-transfer position P9. At secondary-transfer position P9, the toner image conveyed by intermediate transfer belt 15 is secondarily transferred onto paper sheet 31.

Note that, for paper sheet 31, secondary-transfer position P9 is the print start position that is in conformity with the specifications. In this control, position P5 is set and control of the sheet-conveying speed is not started until the leading edge of paper sheet 31 is held between the pair of conveying rollers 35-2 for following reason. The pairs of conveying rollers 35-2 and 35-3 are driven by driving sources 53*b* that are different from driving source 53*a* for conveying rollers 35-1 located upstream of conveying rollers 35-2 and 35-3. When successive paper sheets 31 are conveyed, the timing for each paper sheet 31 can be adjusted only by controlling the speeds of the pairs of conveying rollers 35-2 and 35-3. This makes it possible to feed subsequent paper sheets 31 at a faster speed by use of conveying rollers 35-1 driven by the specially-dedicated driving source 53*a*.

Next, distance X mentioned above will be described.

Parameters that are needed for the calculation are described by referring to FIGS. 4 to 6, and 8.

The diagram shown in FIG. 4 illustrates a section of image forming apparatus 10 shown in FIG. 1 together with the length of the path for conveying images and the length of the path for conveying papers sheets 31. Distance L1 is the distance from position P10, where LED head 21 is located, to primary transfer position P11. FIG. 5 shows distance L1 in an enlarged manner. Distance L2 is the distance from primary transfer position P11 for black to position P12 where the black toner image formed on intermediate transfer belt 15 arrives when paper sheet 31 reaches conveyance sensor 37-1.

In the first embodiment, the black toner image is conveyed the longest distance. Distance L3 is the distance from position P12 to secondary-transfer position P9. Distance L4 is the distance from the position where the feeding of paper sheet 31 is started to position P4 (S1) of conveyance sensor 37-1 (position P4 (S1) where conveyance sensor 37-1 turns on).

Distance L5 is the distance from position P4 to position P5. Position P5 is the position that the leading edge of paper sheet 31, conveyed at V1, reaches after passing by the pair of conveying rollers 35-2. Position P5 is determined so that the pair of conveying rollers 35-2 can exert enough force to convey sheet of paper 31. The length by which sheet of paper 31 should be inserted between the rollers 35-2 depends on the conveyance load characteristics of the apparatus. Distance L6 is the distance from position P5 to position P8 (S2) where conveyance sensor 37-2 turns on. Distance L7 is the distance from position P8 (S2) of conveyance sensor 37-2 (position P8 (S2) where conveyance sensor 37-2 turns on) to secondary-transfer position P9.

Other parameters are defined as follows. Position P6 is the position where the sheet-conveying speed starts to be decelerated to predetermined speed V2, and is the position that the leading edge of paper sheet 31 reaches time Tx after passing by position P5 (i.e. a position away from position P5 by distance X). Position P7 is the position where the deceleration starting at position P6 is finished. DEC1 is the time taken for the deceleration which takes place from position P6 to position P7 (distance Ld). Distance Lv2 is the distance from position P7, where the sheet-conveying speed reaches predetermined constant speed V2, to position P8, where the speed starts to be accelerated up to the final speed. ACC1 is the time taken for the acceleration which takes place from position P8 to the position where the sheet-conveying speed reaches the final speed (distance La). Constant speed V1 is the speed at which paper sheet 31 is conveyed from position P3 to P6. Constant speed V2 is the speed at which paper sheet 31 is conveyed from position P7 to P8. Speed V3 is the final speed. Distance X is the distance from position P5, which is the position of the leading edge of paper sheet 31 sufficiently inserted between the pair of conveying rollers 35-2, to position P6, where the speed starts to be decelerated. Distance X can be calculated by the following formula (1).

$$L3/V3=(L5+X)/V1+DEC1+(Lv2/V2)+ACC1+(Lv3/V3) \quad (1)$$

where: L3=(length of the image-conveying route)−(L1+L2)

X=distance from P5 to P6 (distance until deceleration is started)

Lv2=L6−(the decelerating distance Ld from P6+X)

Lv3=L7−(the accelerating distance La from P8)

In formula (1) above, both the speed at which intermediate transfer belt 15 conveys the toner image and the final conveying speed of paper sheet 31 are assumed to be speed V3. In practice, the apparatus may have a small difference between the above-mentioned two speeds. With the above-described conditions, the formula (1) is transformed into a linear equation with the variable being the distance X, and thereby distance X is obtained.

In the first embodiment, constant speed V1 at which paper sheet 31 is fed is set at a faster speed than the speed at which intermediate transfer belt 15 conveys the image. Note that the path for conveying paper sheet 31 is shorter than the path for conveying the image. Accordingly, in some cases with a particular timing, constant speed V1 is not necessarily set as fast as described above. Note that, the dashed line in FIG. 6 represent the behavior of the subsequent paper sheet 31.

For comparative purposes, FIG. 7 shows a time chart for sheet-feeding control according to the comparison method. According to the comparison method shown in FIG. 7, when obtaining the timing for secondary transfer of the toner image from intermediate transfer belt 15 onto paper sheet 31, synchronization is achieved by temporarily stopping paper sheet 31. Accordingly, paper sheet 31 is conveyed a longer distance (a longer time) than in the case of the first embodiment from the time when the sheet-conveying speed starts to be decelerated from speed V1 to the time when the sheet-conveying speed is increased to speed V3 (compare the shaded areas in the respective charts). Consequently, if successive paper sheets 31 are printed by the comparison method with the image conveyed at the same speed as that in the first embodiment, a wider gap is left between every two paper sheets 31 than the gap left in the first embodiment. The throughput in the comparison method is not as high as that in the first embodiment. In contrast, in the first embodiment, a wider gap is left between every two paper sheets 31 than the gap left in the comparison method. The throughput in the first embodiment is higher than that in the comparison method.

Note that each time gap between a timing when paper sheet 31 is conveyed by the pair of conveying rollers 35-1 and a timing when the toner image is primarily transferred to intermediate transfer belt 15 from image forming unit 20 is constant. The time gap in the first embodiment is shorter than that in the comparison method. Therefore, the throughput in the first embodiment is higher than that in the comparison method.

In other words, a distance between the first paper sheet 31 (shown by the slid line in FIG. 6) and the second paper sheet 31 (shown by the dashed line in FIG. 6) in the first embodiment is shorter than a distance between the first paper sheet 31 (shown by the slid line in FIG. 7) and the second paper sheet 31 (shown by the dashed line in FIG. 7) in the comparison method. Therefore, the throughput in the first embodiment is higher than that in the comparison method.

Next, the operation of the first embodiment will be described further with reference to FIG. 8.

FIG. 8 illustrates the operation of recovering delay. Here, assume a case where the conveyance of paper sheet 31 is delayed from the predetermined time due to a reason such as a load on the conveyance of paper sheet 31 or slipping of the rollers. When such delay is detected by CPU 40 (serving as a determiner) by comparing the position of the paper sheet 31 with the position of the conveyed toner image at a timing when conveyance sensor 37-1 detects paper sheet 31, the sheet-conveying speed is accelerated to speed V2 that is faster than the ordinary sheet-feeding speed V1. Thus, the delay can be recovered. Detailed description of the operation of recovering delay is given below from the time when the feeding of paper sheet 31 is started.

In the operation shown in FIG. 8, once the feeding of paper sheet 31 is started, it is accelerated up to a predetermined sheet-feeding speed. Then at position P3, control at predetermined constant speed V1 is started. Paper sheet 31 is fed at constant speed V1 until the leading edge of sheet of paper 31 reaches position P4 (S1) where conveyance sensor 37-1 is located. Meanwhile, CPU 40 shown in FIG. 3 calculates the value of the timing (i.e., distance X) specifically described below.

In this calculation, CPU 40 calculates the timing at which the sheet-conveying speed is changed to speed V2 that is faster than speed V1 at which paper sheet 31 is fed between position P3 and position P4. Specifically, CPU 40 calculates distance X (i.e., time Tx) which is the distance between position P5 and a position where the sheet-conveying speed starts to be accelerated up to speed V2. Here, position P5 is the position where the leading edge of paper sheet 31 reaches after passing the pair of conveying rollers 35-2 and advancing further by the predetermined distance.

Distance X thus calculated is used to identify position P6, which is distance X away from position P5. Sheet-conveying-roller driving motors 53 shown in FIG. 3 start to accelerate at position P6, and the speed reaches predetermined speed V2 at position P7. Once the speed reaches speed V2, speed V2 is held until second conveyance sensor 37-2 detects the leading edge of paper sheet 31. When conveyance sensor 37-2 detects the leading edge of paper sheet 31 at position P8, the sheet-conveying speed starts to be decelerated so that it matches the speed at which the toner image on intermediate transfer belt 15 is conveyed, before the leading edge of paper sheet 31 reaches secondary-transfer position P9. The conveying speed of paper sheet 31 is changed to speed V3 before the leading edge reaches secondary-transfer position P9. Speed V3 is equal to the image-conveying speed, and is the speed at which the transfer process can be executed appropriately. Paper sheet 31, whose speed has been decreased to speed V3 upstream of secondary-transfer position P9, is held at speed V3 until paper sheet 31 reaches secondary-transfer position P9. At secondary-transfer position P9, the toner image conveyed by intermediate transfer belt 15 is secondarily transferred onto paper sheet 31. Note that, for paper sheet 31, secondary-transfer position P9 is the print start position that is in conformity with the specifications.

In the above-description, position P5 is set and control of the sheet-conveying speed is not started until the leading edge of paper sheet 31 is between the pair of conveying rollers 35-2 for the following reason. The pairs of conveying rollers 35-2 and 35-3 are driven by the driving source 53*b* that are different from the driving source 53*a* for conveying rollers 35-1 located upstream of conveying rollers 35-2 and 35-3. When successive paper sheets 31 are conveyed, the timing for each paper sheet 31 can be adjusted only by controlling the speeds of the pairs of conveying rollers 35-2 and 35-3.

This method of control makes it possible to feed the subsequent paper sheet 31 at a faster speed by use of conveying rollers 35-1 driven by the specially-dedicated driving source 53*a*.

Next, distance X mentioned in the above-described control method is described below.

The parameters that are needed for the calculation, and are different from those used in the above-described case where the conveyance of paper sheet 31 progresses ahead of the conveyance of the image, will be described below.

Position P6 is the position where the sheet-conveying speed starts to be accelerated to predetermined speed V2, and is the position that the leading edge of paper sheet 31 reaches at time Tx after passing position P5 (i.e. a position away from position P5 by distance X). Position P7 is the position where the acceleration starting at position P6 is finished. ACC2 is the time for acceleration from position P6 to position P7. Distance Lv2 is the distance from position P7, where the sheet-conveying speed reaches predetermined constant speed V2, to position P8, where the sheet-conveying speed starts to be decelerated to the final speed. DEC2 is the time for deceleration from position P8 to the position where the speed reaches the final speed. Constant speed V1 is the speed at which paper sheet 31 is conveyed from position P3 to P6. Constant speed V2 is the speed at which paper sheet 31 is conveyed from position P7 to P8. Speed V3 is the final speed. Distance X is the distance from position P5, which is the position of the leading edge of paper sheet 31 is sufficiently inserted between the pair of conveying rollers 35-2, to position P6, where the sheet convey speeding starts to be accelerated. Distance X can be calculated by the following formula (2).

$$L3/V3=(L5+X)/V1+ACC2+(Lv2/V2)+DEC2+(Lv3/V3) \quad (2)$$

where: L3=(length of the image-conveying route)−(L1+L2)

X =distance from P5 to P6 (distance until acceleration is started)

Lv2=L6−(the accelerating distance La from P6+X)

Lv3=L7−(the decelerating distance Ld from P8)

In formula (2) above, both the speed at which intermediate transfer belt 15 conveys the toner image and the final conveyance speed of paper sheet 31 are assumed to be speed V3. In practice, the there may be a small difference between the above-mentioned two speeds. With the above-described conditions, the formula (2) is transformed into a linear equation with the variable being the distance X, and thereby distance X is obtained.

In the first embodiment, constant speed V1 at which paper sheet 31 is fed is set to a faster speed than the speed at which intermediate transfer belt 15 conveys the image. Note that the path for conveying paper sheet 31 is shorter than the path for conveying the image. Accordingly, in some cases with a particular timing, constant speed V1 is not necessarily set as fast as described above.

As described above, according to the first embodiment, when CPU 40 (serving as a determiner) determines that the conveyance of paper sheet 31 progresses ahead of the conveyance of the toner image on intermediate transfer belt 15 by comparing the position of the paper sheet 31 with the position of the conveyed toner image at a timing when conveyance sensor 37-1 detects paper sheet 31, the sheet-conveying speed is once decelerated to speed V2 that is slower than sheet-conveying speed V1, and then adjusted to the image conveying speed (the conveying speed of the toner image) at the secondary-transfer position. In contrast, when CPU 40 determines that the conveyance of paper sheet 31 is delayed with respect to the conveyance of the toner image on intermediate transfer belt 15 by comparing the position of the paper sheet 31 with the position of the conveyed toner image at a timing when conveyance sensor 37-1 detects paper sheet 31, the sheet-conveying speed is once accelerated to speed V2 that is higher than sheet-conveying speed V1, and then adjusted to the image conveying speed (the conveying speed of the toner image) at the secondary-transfer position.

(Effects of First Embodiment)

According to the first embodiment, paper sheet 31 is not stopped during its conveyance, so the apparatus of the first embodiment has a higher throughput in the printing of successive paper sheets 31 than in the conventional case where paper sheet 31 is stopped and controlled. In addition, secondary-transfer is executed by synchronizing paper sheets 31 on the basis of the positions of the conveyed toner images provided at certain intervals which are used as a reference. Thus, the image-start position measured from the leading edge of paper sheets 31 is stabilized, and also the throughput is stabilized.

According to the first embodiment, driving source 53*a* of the first conveying device (conveying rollers 35-1) is independent from driving source 53*b* of the second conveying device (conveying rollers 35-2 and 35-3). With this configuration, paper sheet 31 is transferred from the first conveying device (35-1) to the second conveying device (35-2 and 35-3), changed (decreased and/or increased) in speed by the second conveying device (35-2 and 35-3), and then adjusted in speed and in position to the toner image on intermediate transfer belt 15 at the secondary-transfer position, while subsequent paper sheet 31 is conveyed by the first conveying device (35-1) at a constant speed without decreasing the conveying speed of subsequent paper sheet 31. Therefore, the throughput of the printing is maintained without deteriorating the image quality.

Second Embodiment (Configuration of Second Embodiment)

The configuration of the image forming apparatus in the second embodiment is identical to the one in the first embodiment.

(Operation of Second Embodiment)

Figure 9:
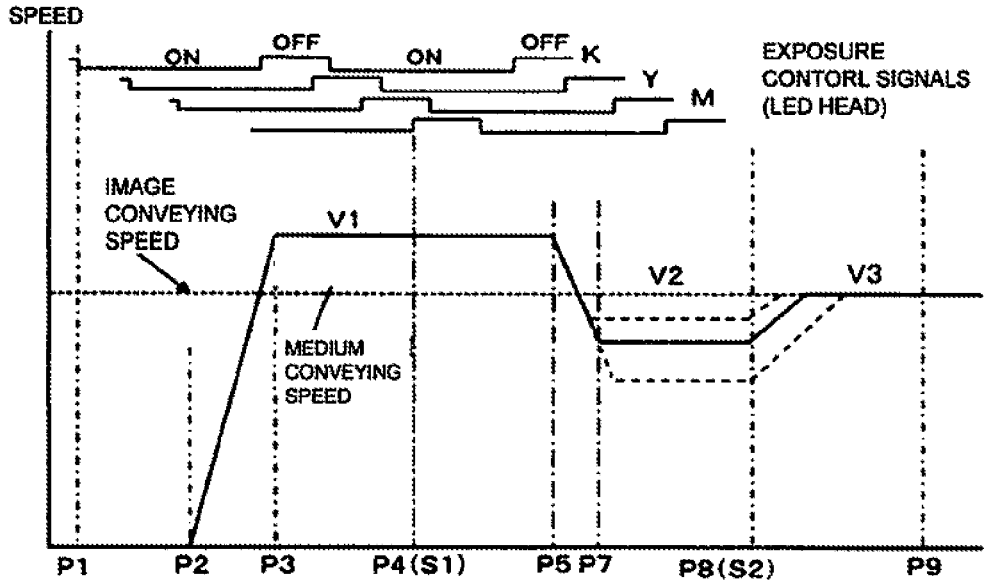
FIG. 9 is a chart illustrating a method of adjusting the speed according to the second embodiment of the invention when the conveyance of sheet of paper 31 progresses ahead of the conveyance of the image in the operation shown in FIG. 4.
Figure 11:
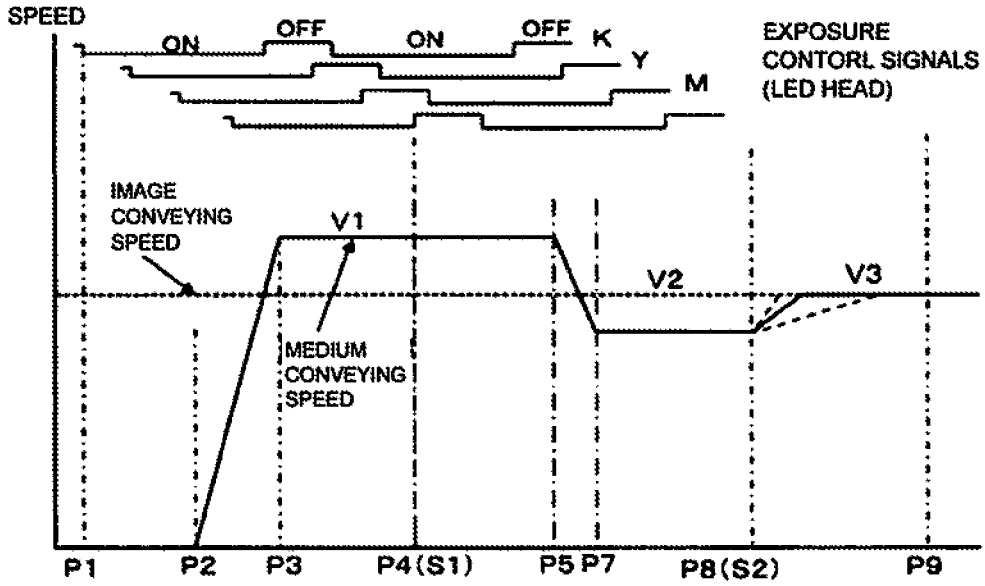
FIG. 11 is a chart illustrating methods of finely adjusting the speed in FIG. 9 and FIG. 10.
Figure 12:
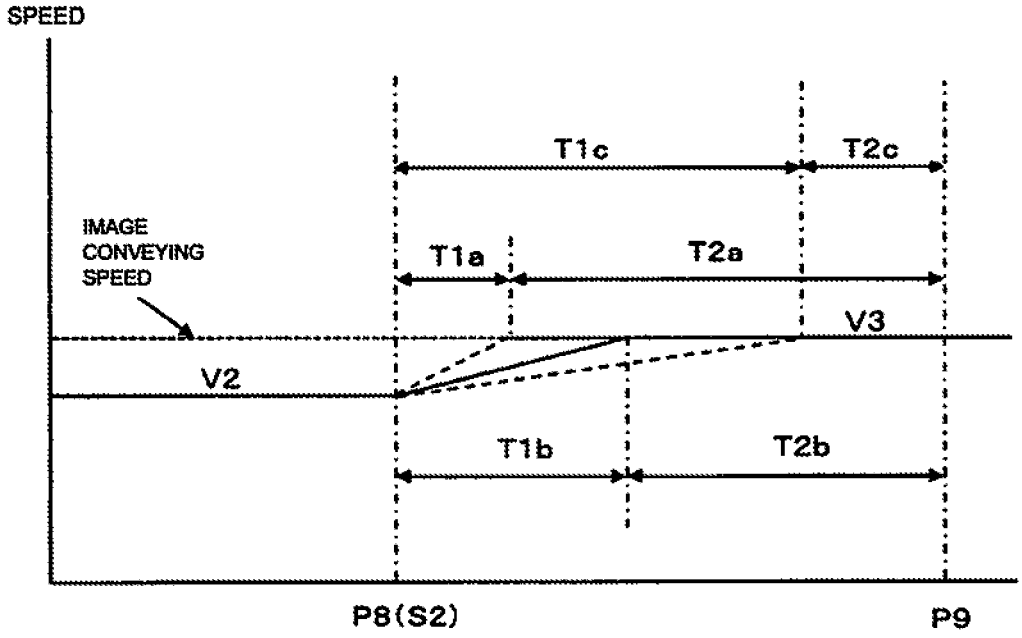
FIG. 12 is an enlarged chart illustrating a part of FIG. 11.

FIG. 9 is a chart illustrating the method of adjusting the speed according to the second embodiment when the conveyance of paper sheet 31 progresses ahead of the conveyance of the image in the operation shown in FIG. 4. FIG. 10 is a chart illustrating the method of adjusting the speed according to the second embodiment when the conveyance of the image progresses ahead of the conveyance of paper sheet 31 in the operation shown in FIG. 4. FIG. 11 is a chart illustrating methods of finely adjusting the speed in the cases of FIG. 9 and FIG. 10. FIG. 12 is an enlarged chart illustrating a part of FIG. 11.

The operation of the second embodiment is described by referring to FIGS. 9 to 12. As in the case of the first embodiment, image forming apparatus 10 shown in FIG. 4 receives print image data from image-data transferring unit 41, such as a PC or an external apparatus, shown in FIG. 3. Upon receiving the data, image processing circuit 42 begins processing the data. When the data processing is finished and the data is converted to a printable data format, image forming apparatus 10 starts the printing operation. In image forming apparatus 10 of the intermediate transfer type, such as the one employed in the second embodiment, the distance from the most upstream image forming unit 20K to the secondary-transfer position, where rollers 13 and 14 for secondary transfer are located, is commonly longer than the distance by which paper sheet 31 is conveyed from sheet tray 30 to the secondary-transfer position. So, the image forming process is started by image forming units 20 earlier than the start of feeding of paper sheet 31.

The relationship between position P1 and position P2 shown in FIGS. 9 to 12 illustrates the relationship between the above-mentioned two distances.

Once the printing operation is started, LED head 21 first forms an electrostatic latent image at position P1. Then, after a predetermined time, paper-feed roller 32 and subsidiary paper-feed roller 33 start feeding paper sheet 31 at position P2. The speed of fed paper sheet 31 is accelerated to predetermined sheet-feeding speed V1. Then at position P3, a sheet-feeding control at a predetermined constant speed is started. Paper sheet 31 is fed at the constant speed until its leading edge reaches position P4 (S1) where conveyance sensor 37-1 is located. Meanwhile, CPU 40 shown in FIG. 3 calculates the value of the conveying speed described below.

In this calculation, CPU 40 calculates conveying speed V2. Specifically, conveying speed V2 is the speed to which the speed of paper sheet 31 is decreased while it is conveyed from position P4 (S1), where first conveyance sensor 37-1 is located, to position P8 (S2), where second conveyance sensor 37-2 is located, so that the toner image conveyed by intermediate transfer belt 15 and conveyed paper sheet 31 are synchronized with each other at secondary-transfer position P9.

After the leading edge of paper sheet 31 reaches position P4 and the calculation is finished, the leading edge of paper sheet 31 is inserted sufficiently between the pair of conveying rollers 35-2 and reaches position P5. Until this time, paper sheet 31 was conveyed at speed V1. Once the leading edge reaches position P5 and a sufficient force for conveying (or feeding) paper sheet 31 has been secured by the pair of conveying rollers 35-2, sheet-conveying-roller driving motors 53 shown in FIG. 3 start to decelerate, and the speed reaches predetermined speed V2 at position P7. Once the speed reaches speed V2, speed V2 is held until second conveyance sensor 37-2 detects the leading edge of paper sheet 31.

When conveyance sensor 37-2 detects the leading edge of paper sheet 31 at position P8 (S2), the sheet-conveying speed starts to be accelerated so that the sheet-conveying speed matches the speed at which the toner image on intermediate transfer belt 15 is conveyed, before the leading end of sheet of paper 31 reaches secondary-transfer position P9. The conveying speed of paper sheet 31 is changed to speed V3 before the leading edge reaches secondary-transfer position P9. Speed V3 is equal to the image-conveying speed, and is the speed at which the transfer process can be performed appropriately. Paper sheet 31, whose speed has been increased to speed V3 somewhere upstream of secondary-transfer position P9, maintains speed V3 until it reaches secondary-transfer position P9. At secondary-transfer position P9, the toner image conveyed by intermediate transfer belt 15 is secondarily transferred onto sheet of paper 31.

Note that, for paper sheet 31, secondary-transfer position P9 is the print start position that is in conformity with the specifications. In the above-described control method, position P5 is set and control of the sheet-conveying speed is not started until the leading edge of paper sheet 31 is held between the pair of conveying rollers 35-2 for following reason. The pairs of conveying rollers 35-2 and 35-3 are driven by the driving source 53*b* that is different from the driving source 53*a* for conveying rollers 35-1 located upstream of conveying rollers 35-2 and 35-3. When successive paper sheets 31 are conveyed, the timing for each sheet can be adjusted only by controlling the speeds of the pairs of conveying rollers 35-2 and 35-3. This makes it possible to feed the subsequent paper sheet 31 at a faster speed by use of conveying rollers 35-1 driven by the specially-dedicated driving source 53*a*.

Next, conveying speed V2 mentioned in the above-described control method will be described.

Parameters that are needed for the calculation are described by referring to FIGS. 4, 5, and 9.

As described in the first embodiment, the diagram shown in FIG. 4 illustrates a section of image forming apparatus 10 shown in FIG. 1 together with the length of the path for conveying images and the length of the path for conveying papers sheets 31. Distance L1 is the distance from position P10, where LED head 21 is located, to primary transfer position P11. FIG. 5 shows distance L1 in an enlarged manner. Distance L2 is the distance from primary transfer position P11 for black to position P12 where the black toner image formed on intermediate transfer belt 15 arrives when sheet of paper 31 reaches conveyance sensor 37-1. In the second embodiment, the black toner image conveyed the longest distance. Distance L3 is the distance from position P12 to secondary-transfer position P9. Distance L4 is the distance from the position where the feeding of paper sheet 31 is started to position P4 of conveyance sensor 37-1.

Distance L5 is the distance from position P4 to position P5. Position P5 is the position reached by the leading edge of paper sheet 31 being conveyed at speed V1, after passing the pair of conveying rollers 35-2. Position P5 is determined so that the pair of conveying rollers 35-2 can exert enough force to convey sheet of paper 31. Position P5 is also the position where the sheet-conveying speed starts to be changed to the conveying speed V2. Distance L6 is the distance from position P5 to position P8 (S2) of conveyance sensor 37-2. Distance L7 is the distance from position P8 (S2) of conveyance sensor 37-2 to secondary-transfer position P9.

Other parameters are defined as follows. DEC1 is the time for the deceleration which is started at position P5 and finished at position P7 (distance Ld). Distance Lv2 is the distance from position P7, where the sheet-conveying speed reaches constant speed V2 to position P8, where the sheet-conveying speed starts to be accelerated to the final speed. ACC1 is the time for the acceleration that takes place from position P8 to the position where the sheet-conveying speed reaches the final speed (distance La). Constant speed V1 is the speed at which sheet of paper 31 is conveyed from position P3 to P5. Constant speed V2 is the speed at which sheet of paper 31 is conveyed from position P7 to P8. Speed V3 is the final speed. The conveying of paper sheet 31 is held at speed V2 from position P7, where the deceleration of the sheet-convey speed is finished, to position P8, where conveyance sensor 37-2 detects the leading edge and the acceleration to the final speed V3 is started. This speed V2 can be calculated by the following formula (3).

$$L3/V3=L5/V3+DEC1+(L6-Ld)/V2+ACC1+(L7-La)/V3 \quad (3)$$

where: L3=(length of the image-conveying route)−(L1+L2)

DEC1=(V1−V2)/A (Note: A is the slope of deceleration (negative acceleration) of the sheet-conveying motor; the value of A is defined by a deceleration table.)

Ld=V2*DEC1+(V1V2)*DEC1/2

ACC1=(V3V2)/B (Note: B is the slope of acceleration (positive acceleration) of the sheet-conveying motor; the value of B is defined by an acceleration table.)

La=V2*ACC1+(V3−V2)*ACCl/2

In formula (3) above, both the speed at which intermediate transfer belt 15 conveys the toner image and the final conveying speed of paper sheet 31 are assumed to be speed V3. In practice, there may be a small difference between the above-mentioned two speeds. With the above-described conditions, formula (3) is transformed into a quadric equation with the variable being speed V2, and thereby speed V2 is obtained.

In the second embodiment, constant speed V1 at which paper sheet 31 is fed is set at a faster speed than the speed at which intermediate transfer belt 15 conveys the image. Note that the path for conveying paper sheet 31 is shorter than the path for conveying the image. Accordingly, in some cases with particular timing, constant speed V1 is not necessarily set as fast as mentioned above.

FIG. 10 illustrates the operation of recovering delay. Here, assume a case where the conveyance of paper sheet 31 is delayed from the predetermined conveyance time due to such a reason as a load on the conveyance of sheet of paper 31 or slipping of the rollers. This delay of the conveyance of paper sheet 31 can be detected at conveyance sensor 37-1 by comparing the position of paper sheet 31 with the position of the conveyed image. When such delay is detected, the sheet-conveying speed is accelerated to a speed higher than the ordinary sheet-feeding speed. Thus, the delay can be recovered. The operation of recovering delay from the time when the feeding of paper sheet 31 is started is described below.

Once the feeding of paper sheet 31 is started, it is accelerated to a predetermined sheet-feeding speed. At position P3, the sheet-feeding speed is controlled at a predetermined constant speed V1. Paper sheet 31 is fed at constant speed V1 until the leading edge reaches position P4 (S1) where conveyance sensor 37-1 is located. Meanwhile, CPU 40 shown in FIG. 3 calculates the value of conveying speed V2 described below.

In this calculation, CPU 40 calculates conveying speed V2. Specifically, convey speed V2 is a speed, faster than the image-conveying speed, at which paper sheet 31 is conveyed from position P4 (S1) where first conveyance sensor 37-1 is located, to position P8 (S2), where second conveyance sensor 37-2 is located, so that the toner image conveyed by intermediate transfer belt 15 and paper sheet 31 are synchronized with each other at secondary-transfer position P9.

After the leading edge of paper sheet 31 reaches position P4 and the calculation is finished, the leading edge is inserted sufficiently between the pair of conveying rollers 35-2 and reaches position P5. Until this time, paper sheet 31 was conveyed at speed V1. Once the leading edge reaches position P5 and sufficient force for conveying (or feeding) sheet of paper 31 has been secured by the pair of conveying rollers 35-2, sheet-conveying-roller driving motors 53 shown in FIG. 3 start to decelerate, and the speed reaches predetermined speed V2 at position P7. Once the speed reaches speed V2, it is held until second conveyance sensor 37-2 detects the leading edge. When conveyance sensor 37-2 detects the leading edge of paper sheet 31 at position P8 (S2), the sheet-conveying speed starts to be decelerated so that it matches the speed at which the toner image on intermediate transfer belt 15 is conveyed, before the leading end of sheet of paper 31 reaches secondary-transfer position P9. The conveying speed of paper sheet 31 is changed to speed V3 before the leading edge reaches secondary-transfer position P9. Speed V3 is equal to the image-conveying speed, and is the speed at which the transfer process can be performed appropriately. Paper sheet 31 whose speed has been decreased to speed V3 somewhere upstream of secondary-transfer position P9 is held at speed V3 until it reaches secondary-transfer position P9. At secondary-transfer position P9, the toner image conveyed by intermediate transfer belt 15 is secondarily transferred onto sheet of paper 31.

Note that, for paper sheet 31, secondary-transfer position P9 is the print start position that is in conformity with the specifications. In the above-described control method, position P5 is set and control on the sheet-conveying speed is not started until the leading edge of paper sheet 31 between the pair of conveying rollers 35-2 for following reason. The pairs of conveying rollers 35-2 and 35-3 are driven by the driving source 53*b* that is different from the driving source 53*a* for conveying rollers 35-1 located upstream of conveying rollers 35-2 and 35-3. When successive paper sheets 31 are conveyed, the timing for each sheet can be adjusted only by controlling the speeds of the pairs of conveying rollers 35-2 and 35-3. This method of control makes it possible to feed the subsequent paper sheet 31 at a faster speed by use of conveying rollers 35-1 driven by the specially-dedicated driving source53*a*.

The above-described control method is used in a case where the conveyance of paper sheet 31 is delayed relative to the conveyance of the image. If the delay is in a certain state, the conveying speed is not decelerated at position P5, but is accelerated to recover the delay.

Next, Conveying speed V2 mentioned in the above-described control method is described.

Parameters that are needed for the calculation, and are different from the ones used in the above-described case where the conveyance of paper sheet 31 progresses ahead of the conveyance of the image, will be described below.

In the second embodiment, some of the dimensions described in FIG. 4 are defined as follows. Distance L5 is the distance from position P4 (S1) to position P5, the position reached by the leading edge of paper sheet 31, conveyed at speed V1, after passing the pair of conveying rollers 35-2.

Position P5 is such that the pair of conveying rollers 35-2 can exert an enough force to convey sheet of paper 31. Position P5 is also the position where the sheet-conveying speed starts to be changed to the convey speed V2. Distance L6 is the distance from position P5 to position P8 (S2) of conveyance sensor 37-2. Distance L7 is the distance from position P8 (S2) of conveyance sensor 37-2 to secondary-transfer position P9.

Other parameters are defined as follows. DEC1 is the time for the deceleration which is started at position P5 and finished at position P7 (distance Ld1). Distance Lv2 is the distance from position P7, where the sheet-conveying speed reaches constant speed V2 obtained from the calculation below, to position P8, where the sheet-conveying speed starts to be decelerated to final speed V3. DEC2 is the time for the deceleration which takes place from position P8 to the position where the sheet-conveying speed reaches final speed V3 (distance Ld2). Constant speed V1 is the speed at which paper sheet 31 is conveyed from position P3 to P5. Constant speed V2 is the speed at which paper sheet 31 is conveyed from position P7 to P8. Speed V3 is the final speed. Conveying of paper sheet 31 is held at speed V2 from position P7, where deceleration of the sheet-conveying speed is finished, to position P8 where conveyance sensor 37-2 detects the leading edge of paper sheet 31 and deceleration to final speed V3 is started. This speed V2 can be calculated by the following formula (4).

$$L3/V3=L5/V3+DEC1+(L6-Ld1)/V2+DEC2+(L7-Ld2)/V3 \quad (4)$$

where: L3=(length of the image-conveying route)−(L1+L2)

DEC1=(V1−V2)/A (Note: A is the slope of deceleration (negative acceleration) of the sheet-conveying motor; the value of A is defined by a deceleration table.)

Ld1=V2*DEC1+(V1−V2)*DEC1/2

DEC2=(V2−V3)/B (Note: B is the slope of acceleration (positive acceleration) of the sheet-conveying motor; the value of B is defined by an acceleration table.)

Ld2=V3*DEC2+(V2−V3)*DEC2/2

In formula (4) above, both the speed at which intermediate transfer belt 15 conveys the toner image and the final conveying speed of paper sheet 31 are assumed to be speed V3. In practice, there may be a small difference between the above-mentioned two speeds. With the above-described conditions, the formula (4) is transformed into a quadric equation with the variable being speed V2, and thereby Speed V2 is obtained.

In the second embodiment, constant speed V1 at which paper sheet 31 is fed is set faster than the speed at which intermediate transfer belt 15 conveys the image. Note that the path for conveying paper sheet 31 is shorter than the path for conveying the image. Accordingly, in some cases with a particular timing, constant speed V1 is not necessarily set as fast as mentioned above.

FIGS. 11 and 12 show how fine adjustment is carried out. When paper sheet 31 is conveyed to position P8, where second conveyance sensor 37-2 is located, the leading edge is detected by second conveyance sensor 37-2. At the time of this detection, the toner image conveyed by intermediate transfer belt 15 is expected to be at a certain position. If the toner image is not at the expected position, the difference is eliminated by finely adjusting the time or the distance of the acceleration or the deceleration.

Three acceleration times are used for three cases of the fine adjustment. Time T1*a* is an acceleration time used for a first case where, when the leading edge of paper sheet 31 reaches conveyance sensor 37-2, the toner image is at a position downstream of the expected position in the conveying direction. That is, the toner image reaches secondary-transfer position P9 earlier than paper sheet 31. Time T1*b* is an acceleration time used for a second case where the conveyance of the toner image and the conveyance of paper sheet 31 are synchronized as expected. Time T1*c* is an acceleration time used for a third case where the toner image is at a position located upstream of the expected position in the conveying direction. That is, the toner image reaches secondary-transfer position P9 later than paper sheet 31. Time T2*a* is the time it takes for paper sheet 31, conveyed at speed V3, to reach secondary-transfer position P9 when the acceleration for Time T1*a* is finished. Time T2*b* is the time it takes for paper sheet 31, conveyed at final speed V3, to reach secondary-transfer position P9 when the acceleration for time T1*b* is finished. Time T2*c* is the time it takes for paper sheet 31, conveyed at speed V3, to reach secondary-transfer position P9 when the acceleration for time T1*c* is finished.

Of the three different acceleration methods, how to calculate time T1*c* and time T2*c* is described below as an example.

First the speeds and distances that are necessary for the calculation of times T1*c* and T2*c* will be defined. Speed V2 is an intermediate adjustment speed at which paper sheet 31 is conveyed until reaching position P8, where conveyance sensor 37-2 is located. Speed V3 is a final speed that matches the image-conveying speed and is the speed at which the transfer process can be performed appropriately. Distance Limg is the distance remaining for the toner image to reach secondary-transfer position P9 from a position where the toner image has been conveyed at the time when conveyance sensor 37-2 detected the leading end of paper sheet 31. Distance L7 is the distance from position P8, where conveyance sensor 37-2 is located, to secondary-transfer position P9. The relations of the times and the distances mentioned above are summarized by simultaneous liner equations in two unknowns in the following formula (5).

$$L7=(V3-V2)*T1c/2+V2*T1c+V3-T2c \quad (5)$$

Where: T1*c*+T2*c*=Limg/V3

In formula (5) above, both the speed at which intermediate transfer belt 15 conveys the toner image and the final conveying speed of paper sheet 31 are assumed to be speed V3. In practice, there may be a small difference between the above-mentioned two speeds.

The equations (5) are solved for time T1*c* and time T2*c*. Once the leading edge of paper sheet 31 passes by conveyance sensor 37-2, the conveying speed is accelerated for time T1*c* until it reaches final speed V3. Then, the secondary transfer is carried out while sheet of paper 31 is being conveyed at final speed V3.

The calculated acceleration time is used, for example, to select one of the acceleration tables having been provided beforehand so as to correspond to various acceleration times. Alternatively, the calculated acceleration time is used to create an acceleration table using a formula to calculate the acceleration table. The acceleration table thus prepared is used to control the acceleration from position P7.

(Effects of Second Embodiment)

In the second embodiment, the transfer timing can be finely adjusted immediately before the secondary transfer. Accordingly, in addition to the effects obtained in the first embodiment, accuracy of the control of the image-start position measured from the leading edge of paper sheet 31 can be improved.

(Modified Examples of First and Second Embodiments)

The invention may be executed not only in the forms described in the first and second embodiments, but also in various other forms with modifications. The following items (a) and (b) are some of the other forms and the modified examples.

(a) The configurations and the circuit of image forming apparatus 10 shown in FIGS. 1 to 3 may be replaced with other ones. In the configurations described in Embodiments 1 and 2, intermediate transfer belt 15 and LED heads 21 are included. Alternatively, the invention is applicable to an apparatus of the intermediate-transfer-drum type or an apparatus including a laser light source. In addition, in Embodiments 1 and 2, the toner image is transferred onto paper sheet 31, but other kinds of printing media may be used.

(b) The descriptions in Embodiments 1 and 2 are based on a case where image forming apparatus 10 is a color electrophotographic printer. The invention is applicable to various other image forming apparatus of the intermediate transfer type, such as photocopiers, fax machines, and multifunction printer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

an image forming unit configured to form an image on the basis of image data;

an intermediate transfer member configured to be driven at a predetermined moving speed, the image being primarily transferred from the image forming unit onto the intermediate transfer member;

a transfer unit configured to secondarily transfer the image, primarily transferred onto the intermediate transfer member, onto a media;

a conveying unit configured to convey the media to the transfer unit;

a media detector disposed at the conveying unit and configured to detect the media that is being conveyed; and a conveying speed controller configured to control a conveying speed at which the conveying unit conveys the media, wherein the conveying speed controller controls the conveying unit to maintain the conveying speed at a constant conveying speed until the media is conveyed to the media detector, and after the media detector detects the media, the conveying speed controller controls the conveying unit to change the constant conveying speed, wherein the media detector comprising:

a first detector configured to detect the media; and a second detector provided downstream of the first detector in a media conveying direction and upstream of a secondary-transfer position in the media conveying direction, wherein the conveying speed controller controls the conveying unit to change the conveying speed of the media from a first conveying speed to a second conveying speed different from the first conveying speed after the first detector detects the media and before the second detector detects the media, to maintain the conveying speed of the media at the second conveying speed, to change the conveying speed of the media from the second conveying speed to a third conveying speed different from the second conveying speed after the second detector detects the media, and to maintain the conveying speed of the media at the third conveying speed until the media arrives at the transfer unit.

2. The image forming apparatus according to claim 1, wherein the image forming unit includes an image carrier configured to carry thereon the image.

3. The image forming apparatus according to claim 1, wherein the intermediate transfer member is a endless belt.

4. The image forming apparatus according to claim 1, further comprising a determiner configured to determine a positional relationship between the image on the intermediate transfer member and the media when the media detector detects the media, wherein the conveying speed controller controls the conveying unit to increase the conveying speed of the media when the determiner determines that the conveyance of the media of is delayed relative to the conveyance of the image.

5. The image forming apparatus according to claim 1, further comprising a determiner configured to determine a positional relationship between the image on the intermediate transfer member and the media when the media detector detects the media, wherein the conveying speed controller controls the conveying unit to decrease the conveying speed of the media when the determiner determines that the conveyance of the media progresses ahead of the conveyance of the image.

6. The image forming apparatus according to claim 1, wherein when the conveying speed controller controls the conveying unit to change the conveying speed of the media to the substantially same speed as the moving speed of the intermediate transfer member after the second detector detects the media but not beforehand, the conveying speed controller controls an acceleration of the conveying speed until the conveying speed reaches the moving speed of the intermediate transfer member, thereby controlling the position of the media when the conveying speed reaches the moving speed.

7. The image forming apparatus according claim 1, wherein the conveying unit includes:

a conveying roller configured to convey the media; and a conveyance sensor serving as the media detector.

8. The image forming apparatus according to claim 1, wherein the conveying unit includes:

a first conveying device provided upstream of the first detector in the medium conveying direction; and a second conveying device provided downstream of the first detector and upstream of the second detector.

9. The image forming apparatus according to claim 8, further comprising:

a first driving source configured to drive the first conveying device; and a second driving source configured to drive the second conveying device.

10. The image forming apparatus according to claim 9, wherein the conveying speed controller controls the first conveying device and the second conveying device such that the driving speeds of the first and second conveying devices are different.

11. The image forming apparatus according to claim 10, wherein a conveying speed of the medium conveyed by the first conveying device is constant, the second conveying device increases or decreases the conveying speed of the medium from the constant conveying speed by the first conveying device.

12. The image forming apparatus according to claim 8, wherein a conveying speed of the medium conveyed by the first conveying device is set greater than the moving speed of the intermediate transfer member.

13. The image forming apparatus according to claim 1, wherein the conveying speed controller controls the conveying unit to maintain a constant conveying speed until the media is conveyed to the media detector, when the media detector detects the media, the conveying speed controller controls the conveying unit to change the constant conveying speed to substantially the same speed as the moving speed of the intermediate transfer member, and wherein a definition that the conveying speed of the media and the moving speed of the intermediate transfer member are substantially the same means that a ratio of a difference between the speed of the intermediate transfer member and the conveying speed of the media to the speed of the intermediate transfer member is in a range of ±15%.

14. The image forming apparatus according to claim 1, wherein the conveying speed controller controls the conveying unit to maintain a constant conveying speed until the media is conveyed to the media detector, when the media detector detects the media, the conveying speed controller controls the conveying unit to change the constant conveying speed to substantially the same speed as the moving speed of the intermediate transfer member, wherein a definition that the conveying speed of the media and the moving speed of the intermediate transfer member are substantially the same means that a ratio of a difference between the speed of the intermediate transfer member and the conveying speed of the media to the speed of the intermediate transfer member is in a range of ±5%.

15. The image forming apparatus according to claim 1, wherein the conveying speed controller calculates a timing for changing the conveying speed, and controls the conveying unit to change the conveying speed based on the calculated timing.

16. The image forming apparatus according to claim 1, wherein the conveying speed controller controls the conveying unit to change the conveying speed after the media detector detects the media.

17. The image forming apparatus according to claim 1, wherein after the media detector detects the media, the conveying speed controller is configured to control the conveying unit to change the constant conveying speed to a predetermined conveying speed.

18. The image forming apparatus according to claim 1, wherein the conveying speed controller is configured to control the conveying unit to convey the media from a media storage unit to the transfer unit without stopping the conveyance of the media.

19. The image forming apparatus according to claim 1, wherein the conveying speed controller is configured to control the conveying speed of the conveying unit that is conveying the sheet of paper without decreasing the conveying speed of a subsequent sheet of paper to be conveyed by the conveying unit.

20. The image forming apparatus according to claim 1, wherein the conveying speed of the media is changed in a linear manner from the second conveying speed to the third conveying speed starting at a position where the media has been detected by the second detector to a position downstream of the second detector that is upstream of the transfer unit.

* * * * *